United States Patent [19]

Kako et al.

[11] 4,225,090

[45] Sep. 30, 1980

[54] DEVICE FOR PAINTING BY ELECTROSTATIC POWDER SPRAYING

[75] Inventors: Hiroyoshi Kako, Aichi; Nobuo Kobayashi, Toyota, both of Japan

[73] Assignee: Toyota Jidosha Kogyo Kabushiki Kaisha, Toyota, Japan

[21] Appl. No.: 73,494

[22] Filed: Sep. 7, 1979

[51] Int. Cl.[3] ..... B05B 5/00

[52] U.S. Cl. ..... 239/692; 239/707; 361/215; 361/227

[58] Field of Search ..... 427/27-30, 427/32, 33; 118/629-635; 239/690-708; 361/215, 226, 227; 406/191, 196

[56] References Cited

U.S. PATENT DOCUMENTS

| | | | |
|---|---|---|---|
| 2,590,534 | 3/1952 | Hampe | 361/227 |
| 2,742,185 | 4/1956 | Landry | 427/27 X |
| 3,070,132 | 12/1962 | Sheridan | 361/215 X |
| 3,473,087 | 10/1969 | Slade | 361/215 |
| 3,903,321 | 9/1975 | Schaad | 361/227 X |
| 3,907,955 | 9/1975 | Viennot | 361/215 X |
| 4,009,829 | 3/1977 | Sickles | 118/629 X |
| 4,020,393 | 4/1977 | Porter | 361/227 |
| 4,071,192 | 1/1978 | Myers | 361/227 X |
| 4,090,666 | 5/1978 | Peck | 239/692 |
| 4,110,486 | 8/1978 | Lacchia | 427/27 |

*Primary Examiner*—Morris Kaplan

*Attorney, Agent, or Firm*—Finnegan, Henderson, Farabow, Garrett & Dunner

[57] ABSTRACT

A device for painting by electrostatic powder spraying wherein a passage for triboelectrifying powder particles is formed in an electrically conductive housing and is surrounded by an electric insulator layer of a synthetic macromolecular material, such as nylon or fluorocarbon resin, containing powder of an electrically conductive material, such as copper, aluminum or carbon. As the electrostatic powder moves through the passage, it frictionally engages the insulator layer and causes an electric charge on the surface of the electric insulator, due to the triboelectrification movement in the electric insulator, and a current flows to the powder. Therefore, powder particles can be continuously triboelectrified without suppling any voltage or with supplying a very low voltage for forming an electric field.

4 Claims, 2 Drawing Figures

DEVICE FOR PAINTING BY ELECTROSTATIC POWDER SPRAYING

BACKGROUND OF THE INVENTION

This invention relates to a device or a gun for painting by electrostatic powder spraying.

Conventionally known are various types of devices for painting by electrostatic powder spraying, wherein, in general, a corona discharge is utilized for electrifying powder particles so as to electrostatically adhere said powder particles to the surface to be coated. However, according to tests conducted by the inventors of the present invention, only a small percentage of the corona ions is utilized for electrifying the powder particles, and therefore, the electrifying efficiency is low. When the amount of the charge on the powder particles is small, the deposition efficiency is low. More specifically, the deposition efficiency is only 70% for a large plane surface to be coated. If the amount of the charge on the powder particles is increased so as to increase the deposition efficiency, a considerably higher voltage is required to be supplied to an electrode for creating the corona discharge, because the amount of the charge is proportional to the supplied voltage. Accordingly, in conventionally known devices for painting by electrostatic powder spraying, a high voltage, i.e., between 60 KV and 90 KV, is supplied to an electrode for creating the corona discharge. Under such a high voltage, a very large corona current flows.

However, such a high voltage creates problems concerning safety, i.e., the problem of danger when a person touches the electrode and the problem of dust explosion. In addition, when a high voltage is supplied to an electrode so as to discharge the corona, an amount of ions which exceeds the electric breakdown limit may be stored in the deposited powder layer on the surface to be coated, because the corona current is large. As a result, back ionization occurs in the deposited powder layer and crator-like defects are frequently formed in the coated surface. Also, the deposition efficiency is extremely low when the thickness of the powder layer exceeds a certain value.

SUMMARY OF THE INVENTION

An object of the present invention is to provide a device for painting by electrostatic powder spraying which can obviate the above-mentioned problems in conventionally known devices.

According to the present invention, a novel device for painting by electrostatic powder spraying is provided, wherein powder particles are electrified by means of triboelectrification instead of corona charging, which is common in conventionally known devices, so that in a device according to the present invention, the supplied voltage can be zero or extremely low.

More specifically, according to the present invention a device for painting by elecrostatic powder spraying is provided wherein a passage for triboelectrifying powder particles is surrounded by a thin layer of an electric insulator containing an electrically conductive material, such as a metallic powder, and the layer of the electric insulator is grounded, as a result, a current of frictional electricity is formed in the layer of the electric insulator and powder particles are continuously triboelectrified.

In an embodiment of the present invention, a device for painting by electrostatic powder spraying is provided, wherein the electric insulator forming the layer surrounding the passage for triboelectrifying powder particles is of a synthetic macromolecular material, such as nylon or fluorocarbon resin, which is located at the end of the triboelectrifying passage, and as a result, almost any kind of powder can be triboelectrified at a high voltage.

BRIEF DESCRIPTION OF THE DRAWINGS

An embodiment of the present invention will be explainted in detail hereinafter with reference to the accompanying drawings, wherein.

DETAILED DESCRIPTION OF THE INVENTION

Figure 1:
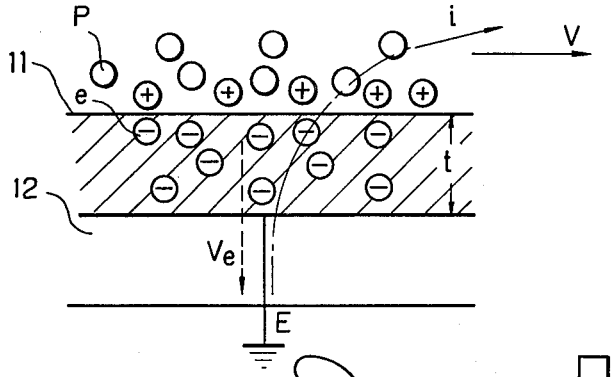
FIG. 1 is an explanatory view, wherein the principle of the present invention is illustrated.

The principle of the present invention will now be explained with reference to FIG. 1. When a powder particle P is advanced in a direction designated by an arrow V while it is in frictional contact with a surface of an electric insulator 11, the powder particle P and the electric insulator 11 are charged with positive and negative polarities, respectively. The polarities of the electricities depend on the materials of the powder particles P and the electric insulator 11. In FIG. 1, the particles of the powder are charged positively and the surface of the electric insulator 11 is charged negatively. The symbol e designates an electron in the electric insulator. As soon as the surface of the electric insulator where powder particles rub is filled with electron e, the speed of electrification of the powder particles P is decreased. As a result, the tribo-charge of the powder particles under such a circumstance becomes insufficient for electrostatic powder coating.

To obviate the decrease in the speed of electrification of powder particles, a method was utilized by the inventors of the present invention wherein the thickness of the electric insulator was reduced enough for electrons e in the electric insulator to move from the surface to the housing 12 of the device for electrostatic powder spraying, so that the powder particles P could be continuously electrified. However, when using this method it was necessary that the electric insulator be formed in a thin layer with a uniform thickness. However, it was very difficult to obtain a thin and uniform layer of an electric insulator attached to or adhered on the surface of the housing of the device for electrostatic powder spraying. Furthermore, if the thickness of the electric insulator 11 was excessively small, the electric insulator 11 was sometimes damaged when it was rubbed with powder particles.

According to the present invention the electric insulator 11 contains an electrically conductive material. As a result, the electrons e are moved in a direction designated by an arrow Ve. Accordingly, powder particles P which rub the electric insulator 11 containing an electrically conductive material can continuously be electrified. Because the conductive material is contained in the electric insulator 11, it is not necessary for the thickness t of the electric insulator to be excessively thin. As a result, it becomes very easy to construct the passage surrounded by the electric insulator by attaching the electric insulator layer to the surface of the housing or adhering it to the surface of the housing.

It should be noted that the fact that the electrons e move in the direction of the arrow Ve, as mentioned above, means that an electric current flows from the housing 12 of the device for electrostatic powder spraying to the powder particles P through the electric insulator 11, as designated by a dot dash line i. In some cases, a voltage may be supplied between the housing 12 of the device for electrostatic powder spraying and the ground E, so that the current i is increased. When the polarities of the powder particles P and the electric insulator 11 are the reverse of those illustrated in FIG. 1, since the current flows in a direction opposite to that illustrated in FIG. 1, the polarity of the voltage must be the reverse of that explained above.

Figure 2:
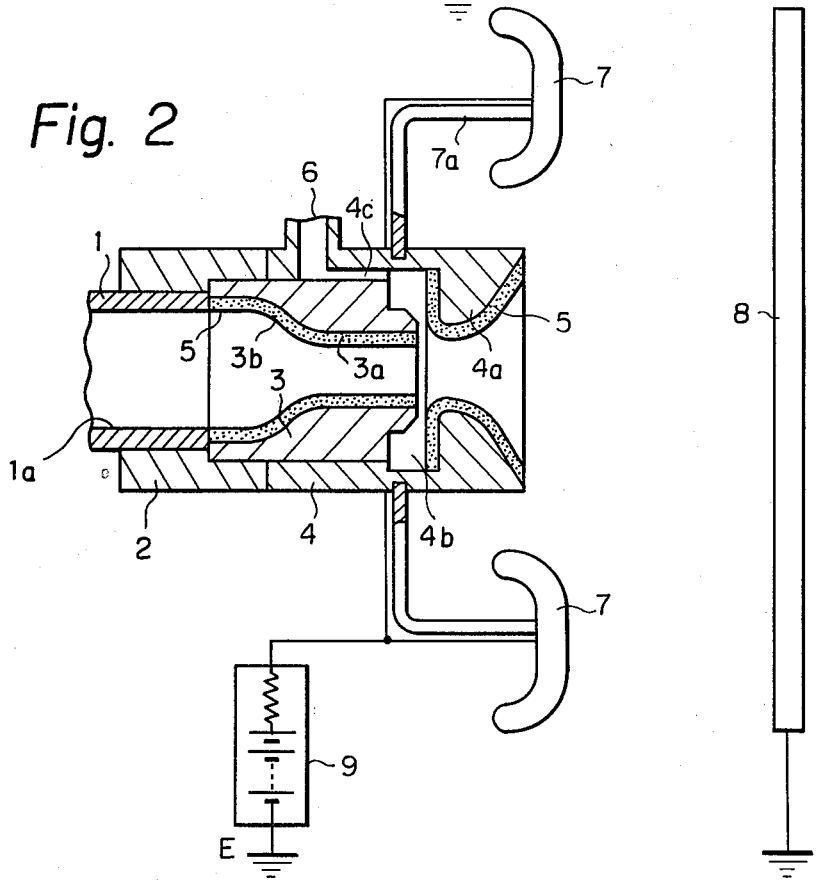
FIG. 2 is a cross sectional elevational view of an embodiment according to the present invention.

A device or gun for painting by electrostatic powder spraying according to the present invention will be explained hereinbelow with reference to FIG. 2. In FIG. 2, a powder particle (not shown) is conveyed through a passage 1*a*, formed within a supply member 1, for supplying a powder particle by means of compressed air or a conveyor belt in a conventionally known manner. The supply member 1 is connected to an injecting nozzle body 3 via a connector 2. The injecting nozzle body 3 is interconnected to an outer cylinder 4 having an annular cylindrical shape. The nozzle body 3 has formed therein concavoconical shaped nozzle 3*b* and a cylindrical nozzle 3*a* communicating with the nozzle 3*b*. The outer cylinder 4 includes an opening 4*a* expanding outwardly and located in front of the cylindrical nozzle 3*a* and an annular hollow space 4*b* surrounding the portion where the front end of the cylindrical nozzle 3*a* faces the entrance of the expanding opening 4*a*. The outer cylinder 4 further includes a passage 4*c* which communicates the annular hollow space 4*b* with an auxiliary air supply conduit 6 adapted to be communicated with a compressed air supply source via a hose (not shown). The cylindrical nozzle 3*a* and the expanding opening 4*a* form a diffuser. An electric insulating material 5 of a synthetic macromolecular material, such an nylon or fluorocarbon resin known as "Teflon" (trademark of E. I. Dupont de Nemours), located at the end of the triboelectrifying passage and containing powder of an electrically conductive material, such as copper, aluminum or carbon, is adhered on the inside of the nozzle body 3 and the expanding opening 4*a* respectively. On the other hand, the injecting nozzle body 3 and the outer cylinder 4 are made of an electrically conductive material, such as copper, aluminum, brass or iron.

Electrodes 7 for forming an electric field are securedly fixed on the outer cylinder 4 by means of brackets 7*a* and are grounded via a direct current power source 9 of high voltage. The electrodes project from a plane wherein the front end of the expanding opening 4*a* of the outer cylinder 4 lies, and the edges thereof are rounded so that an electric corona does not take place.

After an article 8 to be coated is grounded, the expanding opening 4*a* of the device is directed to the surface to be coated of the article 8, and then, powder particles are supplied through the supply member 1 and auxiliary air is supplied through the auxiliary air supply conduit 6. Powder particles are triboelectrified by friction with the electrical insulator 5 while it is advanced within the injecting nozzle body 3 and reaches the extending opening 4*a*, where it is uniformly dispersed by means of the auxiliary air. The triboelectrified and dispersed powder particles become adhered to the article 8 to be coated by the electrical field. Due to the special construction of the layer of the electric insulator, powder particles are able to be continuously charged as explained above with reference to FIG. 1.

As will be apparent from the above explanation, in the present invention, since all or almost all of the powder is triboelectrified, it is unnecessary to excessively increase the voltage for forming an electric field and for electrifying the powder particles. In other words, the voltage supplied to the device of the present invention can be low. As a result, the level of danger for personal safety and the level of danger of causing a dust explosion can be reduced from those methods which are utilized in the prior art. In addition, crator-like defects in the deposited powder layer due to back ionization can be minimized. On the other hand, since the powder is fully triboelectrified, a high deposition efficiency, for example, 95% for a large plane article to be coated, can be achieved.

What we claim is:

1. A device for painting by electrostatical powder spraying, which device comprises: a powder supply member having a passage formed therein for supplying powder, a housing connected to said supply member and having a passage formed therein, a polymeric insulator surrounding said passage, said electric insulator containing an electrically conductive powder dispersed therein and being formed in a thin layer and grounded, whereby a current of frictional electricity is formed in said electric insulator layer by friction between said powder and said insulator layer as said powder passes through said passage and said powder from said powder supply member is continuously triboelectrified.

2. A device according to claim 1, wherein said triboelectrifying passage is formed in a diffuser and said device includes an auxiliary air supply connected to said diffuser for dispersing said powder, and an electrode for forming an electric field disposed on said housing.

3. A device according to claim 1 or 2, wherein said electric insulator layer is of a synthetic macromolecular material located at the end of the triboelectrifying passage.

4. A device according to claim 3, wherein said electrically conductive material contained in said electric insulator layer is a metallic powder.

* * * * *